United States Patent [19]

Tabor

[11] Patent Number: 4,910,964

[45] Date of Patent: Mar. 27, 1990

[54] LIQUID CRYOGENIC TRANSFER SYSTEM

[75] Inventor: Melvin J. Tabor, La porte, Tex.

[73] Assignee: The BOC Group, Inc., Murray Hill, N.J.

[21] Appl. No.: 271,112

[22] Filed: Nov. 14, 1988

[51] Int. Cl.[4] ..... F17C 9/04

[52] U.S. Cl. ..... 62/50.3

[58] Field of Search ..... 62/55, 50.3

[56] References Cited

U.S. PATENT DOCUMENTS

| | | | |
|---|---|---|---|
| 2,467,413 | 4/1949 | Wildhack | 62/55 |
| 2,487,863 | 11/1949 | Garretson | 62/55 |
| 2,632,302 | 3/1953 | Steele | 62/55 |
| 2,657,541 | 11/1953 | Schilling | 62/55 |
| 2,973,629 | 3/1961 | Lady | 62/55 |
| 3,131,045 | 4/1964 | Schilling | 62/55 |
| 3,154,928 | 11/1964 | Harmens | 62/50.3 |
| 3,234,746 | 2/1966 | Cope | 62/55 |
| 3,570,261 | 3/1971 | Schwartman | 62/50.3 |
| 3,797,263 | 3/1974 | Shahir et al. | 62/55 |
| 4,593,763 | 6/1986 | Burke | 165/302 |
| 4,598,554 | 7/1986 | Bastian | 62/51 |

*Primary Examiner*—Ronald C. Capossela

*Attorney, Agent, or Firm*—David A. Draegert; Larry R. Cassett

[57] ABSTRACT

Liquefied gases are transferred by a method and apparatus which uses the energy of the pressurized liquefied gas to drive an air motor which in turn drives a pump for transferring the liquefied gas from one container to another. This method is advantageous over known methods which use fuel or electric powered motor systems for transporting liquefied gases on tank trucks. The apparatus and method of the invention are particularly useful on tank trucks transporting liquid carbon dioxide.

13 Claims, 1 Drawing Sheet

LIQUID CRYOGENIC TRANSFER SYSTEM

BACKGROUND OF THE INVENTION

The invention relates to a method and apparatus for transferring pressurized liquefied gas from one storage container to another. Specifically, a portion of vaporized liquefied gas occurring above the liquefied gas in a storage container is used to drive an air motor which in turn drives a pump that transfers the liquefied gas from one storage container to another storage container. Further, the apparatus of the invention may be mounted on a tank truck and used to transfer liquefied gas into or out of the tank truck storage container.

Liquefied gases are used for many diverse purposes in industry. Typically these gases are stored in a liquid state and must be transported from one location to another.

For example, carbon dioxide may be obtained from industrial processes, liquefied and stored in containers at one location. The liquid carbon dioxide may then be transferred to a tank truck in liquid form and transported to another location or plant where the liquid carbon dioxide may be used in industrial processes. The liquid carbon dioxide must therefore be transferred from a first storage container to the tank truck, and when it reaches its final destination it must be transferred from the tank truck to another storage container.

Typically fuel powered motors are used in conjunction with pumps to transfer liquefied gases such as liquid carbon dioxide from a tank truck to a storage container or from a storage container to a tank truck. The fuel powered motor and pump are usually mounted on the tank truck.

As an alternative to fuel powered motors, electric powered motors have been used to drive the pump for transferring liquefied gases. The electric powered motor and pump are usually mounted on the tank truck, and the electric power must be supplied by an external source at the location where the liquefied gas is transferred.

Electric or fuel powered motor systems for transferring liquefied gases to or from tank trucks have several disadvantages. Electric or fuel powered motors present safety risks in many locations where liquefied gases must be transferred to or from a tank truck. For example, in many industrial plants the possibility of flammable vapors exists, and an electric powered motor represents a potential ignition source for these flammable vapors due to electric sparks. Likewise, a fuel powered motor may have hot surfaces that would ignite flammable vapors or it may have an electric ignition system that would generate electric sparks. In fact, many industrial plants have strict rules either prohibiting the use of electric or fuel powered motors in certain areas or requiring very strict procedures for the use of electric or fuel powered motors in those areas.

Fuel or electric powered motors also have the disadvantage of needing frequent maintenance which results in expense and prevents the tank truck from being used while the maintenance is performed.

Further, fuel powered motors are bulky and their weight decreases the payload of liquefied gas that a tank truck can carry. Fuel powered motors have the added disadvantage that fuel must be carried on the tank truck to operate them. Likewise, this fuel is an extra weight that decreases the payload of liquefied gas that the ınk truck can carry, and also represents an added expense due to the cost of the fuel.

Fuel powered motor systems for transferring liquefied gases also have the disadvantage that they can only transfer liquefied gases from a tank truck to a storage container and not from the storage container to the tank truck. This limitation is a result of the non-reversibility of fuel powered motors.

SUMMARY OF THE INVENTION

A portion of the vaporized liquefied gas occurring in a container for storing a liquefied gas under pressure may be used to operate an air motor or similar device which in turn drives a pump for transferring the liquefied gas from that storage container to another. Further, the apparatus of the invention may be mounted on a tank truck so that liquefied gas can be transferred into or out of the tank truck at remote locations.

The method and apparatus of the invention is useful for transferring liquefied gases to or from tank trucks. The method surpasses known methods because it is safer than known methods as it does not provide an ignition source for flammable vapors which may occur in many locations where liquefied gases need to be transferred.

Further, the use of an air motor or similar device results in lower maintenance requirements than known liquefied gas transfer systems using electric or fuel powered motors. The apparatus of the invention is also lighter and requires substantially less space on the tank truck than fuel powered motor systems.

The apparatus of the invention uses a vaporized portion of the liquefied gas as its energy source as opposed to fuel powered motors which are operated with gasoline or diesel fuel. This results in saving the cost of the fuel and eliminates the associated inconvenience of obtaining the fuel. Likewise, electric powered motor systems require an external electric power supply as opposed to the apparatus of the invention which carries its own power source when mounted on a tank truck.

Further, the apparatus for transferring the liquefied gas is substantially lighter than known systems using fuel powered motors. More liquefied gas can therefore be carried in any particular load of the tank truck. This results in an increase in the operating efficiency for transporting liquefied gases from one location to another The apparatus of the invention has the added advantage that it uses fewer moving parts and less piping than known fuel or electric powered systems. This reduces maintenance requirements and results in a system that weighs less which is advantageous for systems mounted on a tank truck.

DETAILED DESCRIPTION OF THE INVENTION

Figure 1:
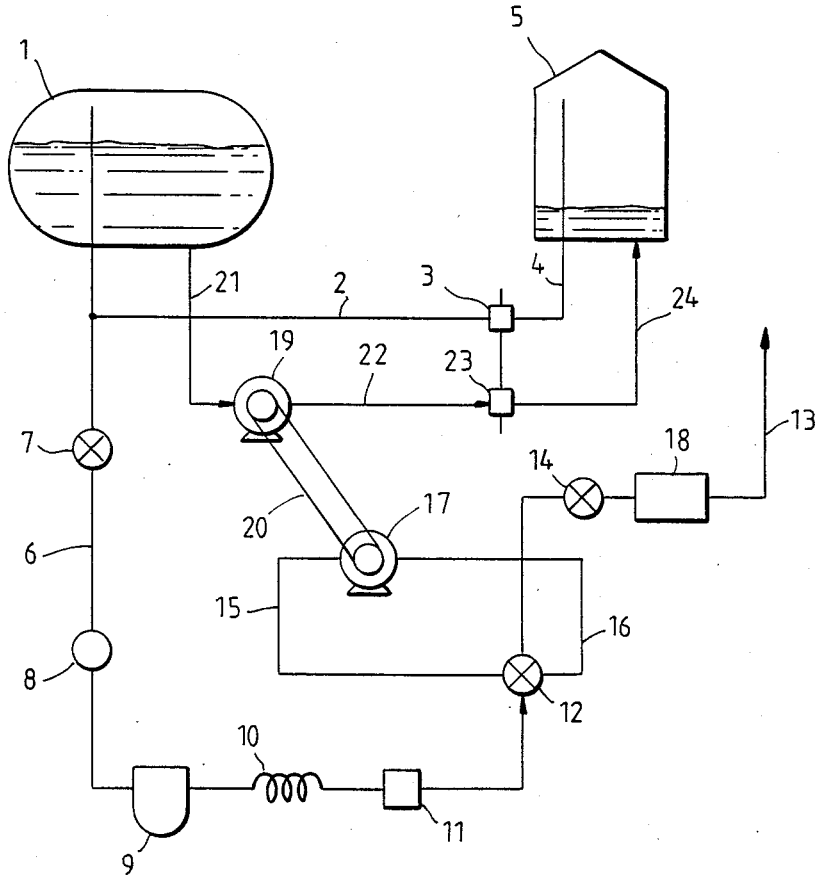
FIG. 1 depicts a schematic drawing of the apparatus of the invention.

Typically liquefied gases such as carbon dioxide need to be transported from one location to another and transferred from one storage container to another. For example, carbon dioxide may be obtained from industrial processes such as ammonia plants and condensed into the liquid state. The liquid carbon dioxide is then maintained in a storage container. The liquid carbon dioxide may then be transferred to a tank truck which in turn transports the liquid carbon dioxide to a remote plant where the liquid carbon dioxide is used for an industrial process. The liquid carbon dioxide is then transferred from the tank truck to another storage container at the remote plant.

Referring now to FIG. 1, a storage container, 1 mounted on a tank truck is shown for storing a liquefied gas under pressure. For example, the liquefied gas may be carbon dioxide stored in the container, 1 at a pressure of approximately 250 psi and a temperature of approximately −15° F. At these conditions the majority of the carbon dioxide is in the liquid state with a small amount of carbon dioxide vapor located above the liquid volume of carbon dioxide in the storage container. Further, the tank truck storage container, 1 contains approximately 20 tons of carbon dioxide at these conditions.

The tank truck container, 1 has a pressure equalization line, 2 with one end located in the vapor space above the liquid carbon dioxide in the tank truck storage container, 1. The line, 2 extends through the container wall and connects to a connector, 3 at the back of the tank truck. The term "line" refers to a pipe, tube, hose, or similar device that is used to transport fluids under pressure from one point to another point.

The connector, 3 is connected to one end of a line, 4 which communicates with the vapor space of a second storage container, 5. It should be appreciated that when liquid carbon dioxide is being transferred from the tank truck storage container, 1 to the second storage container, 5 or from the second storage container to the tank truck storage container the pressure will be equalized due to the communication of the vapor spaces between the two containers.

A vapor inlet line, 6 communicates with the pressure equalization line, 2. The vapor inlet line, 6 includes a valve, 7 for opening and closing the line.

The vapor inlet line, 6 includes a pressure regulator, 8 for reducing the pressure of the vapor from the tank truck storage container to any desired level. For example, the pressure regulator may decrease the pressure of the carbon dioxide vapor from 300 psi to approximately 120 psi.

A filter, 9 is preferably included in the vapor inlet line, 6 to remove any impurities from the carbon dioxide vapor.

The vapor inlet line, 6 preferably includes a heat exchanger, 10 which is used to increase the temperature of the vapor. The heat exchanger may be any commercially available device used for heat exchange. For example, a finned tube heat exchanger with carbon dioxide vapor flowing through the tube and the fins exposed to ambient air may be used. It should be appreciated that the heat exchanger increases the energy of the vaporized liquid carbon dioxide which is later available for conversion to mechanical energy.

The vapor inlet line, 6 connects to the inlet of a four-way valve, 12. The four-way valve has an outlet that connects to a vapor discharge line, 13. The vapor discharge line, 13 includes a valve, 14 to open or close the line. The vapor discharge line, 13 exhausts to the atmosphere at the top of the tank truck.

The vapor discharge line, 13 includes a muffler, 18. The muffler may be any commercially available exhaust gas muffler. Preferably an automobile muffler may be used. It should be appreciated that the muffler reduces the noise associated with discharging the carbon dioxide vapor.

The four-way valve, 12 connects to two other lines, 15 and 16, which are connected to an air motor, 17. These two lines provide for flow of carbon dioxide vapor from the four-way valve to the air motor and then from the air motor back to the four-way valve. It should be appreciated that by changing the position of the four-way valve the flow of carbon dioxide vapor through the air motor can be reversed thereby changing the rotation of the shaft of the air motor. Specifically, the four-way valve, 12 has two positions. In the first position, the valve allows carbon dioxide vapor to flow from the vapor inlet line, 6 to line, 15; through the air motor, 17; through line, 16; through the four-way valve, 12; to the vapor discharge line, 13. In the second position, the flow of carbon dioxide vapor is reversed.

The air motor converts the energy of the flowing carbon dioxide vapor into mechanical force. This is accomplished by the carbon dioxide vapor turning vanes in the air motor which are connected to a shaft. The pressure differential between the vapor space at the tan truck storage container and atmospheric pressure at the vapor discharge line exhaust provides the impetus for the carbon dioxide to flow through the system and operate the air motor.

The air motor, 17 is started by opening valves, 7 and 14, and then may be turned off by closing either valve.

The air motor may consist of any commercially available air motor. For example, a reversible air motor with six vanes that can produce approximately 9 horsepower at a speed of 2000 RPM and an operating pressure of 100 psi may be used for this purpose. Alternately, a similar device that converts the energy of a flowing gas into mechanical energy may be used.

The vapor inlet line, 6 preferably includes an oiler, 11 that deposits oil droplets in the carbon dioxide vapor. Oil entrained in the carbon dioxide vapor is beneficial for reducing wear in the air motor, 17.

The mechanical force generated by the air motor, 17 is transferred to a liquid transfer pump, 19 so that liquid carbon dioxide is pumped from the tank truck storage container, 1 to the second container, 5. If the air motor is reversed by changing the position of the four-way valve, 12 then liquid carbon dioxide can be transferred in the reverse direction, that is from the second storage container, 5 to the tank truck storage container, 1.

The air motor, 17 and liquid transfer pump, 19 may be connected by any commercially available means for connecting a pump and a motor. Preferably, the shafts of the air motor and liquid transfer pump have pulleys attached to them and the mechanical force is transferred from the pulley on the air motor shaft to the pulley on the liquid transfer pump shaft by a belt, 20.

The liquid transfer pump, 19 is connected to a liquid inlet line, 21 at one end, and the other end of the liquid inlet line, 21 is located at the bottom of the tank truck storage container, 1. The liquid transfer pump, 19 is also connected to a liquid discharge line, 22. The other end of the liquid discharge line, 22 is connected at connector, 23 to a line, 24 leading to the bottom of the second storage container, 5.

Any commercially available reversible liquid transfer pump may be used for transferring the liquid. For example, a rotary positive displacement pump with a capacity of 100 GPM may be used.

The equipment necessary for transferring liquid carbon dioxide into or out of the tank truck storage container is preferably adapted to be mounted on the tank truck. Specifically the air motor, 17; liquid transfer pump, 19; four-way valve, 12; heat exchanger, 10; filter, 9; pressure regulator, 8; oiler 11; muffler, 18; valves, 7 and 14; lines, 2, 6, 13, 15, 16, 21, and 22; and connectors, 3 and 23 are all mounted on the tank truck.

Only two connections are required to transfer the liquefied gas at any location when the apparatus of the invention is mounted on a tank truck. That is a connection must be made to the pressure equalization line, 2 via connector, 3 and a connection must be made to the liquid discharge line, 22 via connector, 23. The method and apparatus of the invention may then be used to transfer liquid either from the tank truck to a storage container or from a storage container to the tank truck.

The method and apparatus described above are illustrative of the invention and other variations and modifications may be made without departing from the scope of the invention. It is understood that the details described above are to be interpreted as explanatory and not in a limiting sense.

What is claimed is:

1. A method for transferring a pressurized liquefied gas from a first container containing an amount of the liquefied gas in liquid form and a separate amount of the liquefied gas in vapor form to a second container, the method comprising:

(a) withdrawing a portion of the separate amount of the liquefied gas in vapor form from the first container;

(b) using the withdrawn portion of the vaporized liquefied gas to drive a driving means that converts kinetic energy of the withdrawn portion of the vaporized liquefied gas to mechanical energy;

(c) discharging the withdrawn portion of the vaporized liquefied gas to the atmosphere; and (d) using the mechanical energy from the driving means to drive a pumping means that transfers the amount of liquefied gas in liquid form from the first container to the second container.

2. The method of claim 1 where the liquefied gas is carbon dioxide.

3. The method of claim 1 where the kinetic energy of the withdrawn portion of the vaporized liquefied gas is increased by heat exchange with a fluid.

4. The method of claim 3 where the fluid is ambient air.

5. Apparatus for transferring a pressurized liquefied gas from a first container having a first zone of the liquefied gas in liquid form and a second zone of the liquefied gas in vapor form to a second container, the apparatus comprising:

(a) a driving means suitable for converting kinetic energy of the vaporized liquefied gas in the second zone to mechanical energy;

(b) a vapor inlet line connected to one end to the second zone of vaporized liquefied gas and connected at the other end to the driving means so that a portion of the vaporized liquefied gas is communicated to the driving means;

(c) a vapor discharge line connected at one end to the driving means and open to the atmosphere at the other end so that the portion of the vaporized liquefied gas is exhausted to the atmosphere;

(d) a pumping means suitable for causing a fluid to flow when supplied with mechanical energy;

(e) a coupling means suitable for transferring mechanical energy from the driving means to the pumping means;

(f) a liquid inlet line connected at one end to the first zone of the first container and connected at the other end to the pumping means so that liquefied gas in liquid form is communicated to the pumping means; and (g) a liquid discharge line connected at one end to the pumping means and connected at the other end to the second container so that liquefied gas in liquid form is communicated from the pumping means to the second container.

6. The apparatus of claim 5 further comprising heat exchange means in the vapor inlet to increase the kinetic energy of the vaporized liquefied gas.

7. The apparatus of claim 5 further comprising pressure regulation means suitable for reducing the pressure in the vapor inlet line.

8. The apparatus of claim 5 further comprising filtration means in the vapor inlet line suitable for removing entrained liquids and solids.

9. The apparatus of claim 5 further comprising oiling means in the vapor inlet line suitable for providing lubrication to insure that an effective amount of lubrication is provided to maintain the driving means.

10. The apparatus of claim 5 further comprising muffling means suitable for reducing the noise of gas being discharged from the vapor discharge line.

11. The apparatus of claim 5 where the combination of the driving means and the coupling means is adaptable to produce mechanical energy in a reverse direction such that the pumping means causes the liquefied gas in liquid form to transfer from the second container to the first container.

12. The apparatus of claim 5 further adapted for mounting on a vehicle.

13. The apparatus of claim 5 where the driving means is an air motor

* * * * *